US008202101B2

(12) United States Patent
Zimmerman et al.

(10) Patent No.: US 8,202,101 B2
(45) Date of Patent: Jun. 19, 2012

(54) ELECTRICAL CONNECTOR WITH IMPROVED PEDESTAL FOR MOUNTING A FUSIBLE ELEMENT AND METHOD FOR MAKING THE SAME

(75) Inventors: Terrence B Zimmerman, Carlisle, PA (US); David W Clark, Elizabethtown, PA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 27 days.

(21) Appl. No.: 12/850,667

(22) Filed: Aug. 5, 2010

(65) Prior Publication Data

US 2012/0034823 A1 Feb. 9, 2012

(51) Int. Cl.
*H01R 12/00* (2006.01)

(52) U.S. Cl. ..... 439/70; 439/71

(58) Field of Classification Search ..... 439/66, 439/70, 71, 72, 83, 342, 862
See application file for complete search history.

(56) References Cited

U.S. PATENT DOCUMENTS

| | | | | |
|---|---|---|---|---|
| 6,142,792 | A * | 11/2000 | Yang | 439/70 |
| 6,501,665 | B1 | 12/2002 | Ted | |
| 6,679,709 | B2 * | 1/2004 | Takeuchi | 439/83 |
| 6,702,594 | B2 * | 3/2004 | Lee et al. | 439/83 |
| 6,932,619 | B2 * | 8/2005 | Chen | 439/66 |
| 7,377,795 | B2 * | 5/2008 | Vicich et al. | 439/83 |
| 7,553,182 | B2 * | 6/2009 | Buck et al. | 439/378 |
| 7,666,014 | B2 * | 2/2010 | Yi et al. | 439/248 |
| 7,695,329 | B2 | 4/2010 | Peloza et al. | |
| 7,791,443 | B1 * | 9/2010 | Ju | 336/107 |
| 2009/0264023 | A1 | 10/2009 | Yi et al. | |

* cited by examiner

*Primary Examiner* — Thanh Tam Le
(74) *Attorney, Agent, or Firm* — Ming Chieh Chang; Wei Te Chung; Andrew C. Cheng

(57) ABSTRACT

An electrical connector includes an insulative housing, at lease one contact mounted to the insulative housing and a fusible element mounted to the contact. The contact includes a body portion and a mounting portion extending from the body portion. The mounting portion includes a support portion and first and second tails bent from the support portion along opposite directions in order to form a discrete receiving slot. The first and the second tails are substantially perpendicular to the body portion. The fusible element is received in the receiving slot and is in line with the body portion of the contact for reliable fixation.

10 Claims, 14 Drawing Sheets

ELECTRICAL CONNECTOR WITH IMPROVED PEDESTAL FOR MOUNTING A FUSIBLE ELEMENT AND METHOD FOR MAKING THE SAME

BACKGROUND OF THE INVENTION

1. Field of the Invention

The present invention relates to an electrical connector and a method for making the same, and more particularly to an electrical connector with an improved pedestal for mounting a fusible element and a method for making a contact with such pedestal.

2. Description of Related Art

In high density signal transmission between circuit boards, electrical connectors are often provided with solder balls to be mounted to the circuit boards. U.S. Patent Publication No. 2009/0264023A1 published on Oct. 22, 2009 discloses such a connector assembly including mateable male and female connectors for being mounted to the circuit boards. The contacts of the male and the female connectors each include a flat mounting portion. In mounting process, solder balls are preliminarily soldered to the flat mounting portion in a first reflowing process. In the following soldering process, such solder balls are finally fused under high temperature to be electrically connected to the circuit boards. It is known that, in preliminarily positioning the solder balls, a reflowing process is less effective than a mechanical assembling process.

U.S. Pat. No. 6,679,709 B2 issued to Takeuchi on Jan. 20, 2004 discloses a connector assembly including a plurality of contacts. Each contact includes a body portion and a pair of arms bent laterally from an edge of the body portion. An opening is formed between the pair of arms for mounting a fusible element for being mounted to circuit boards. The fusible element is offset from the body portion and in the case of solder balls, might not be reliably attached to the contacts. U.S. Pat. No. 7,695,329 issued to Peloza et al. on Apr. 13, 2010, also discloses a similar scheme of placing solder wires, in contrast to solder balls, onto the contact.

Hence, an electrical connector with an improved pedestal for reliably mounting fusible elements and a method for making a contact with such pedestal are desired.

BRIEF SUMMARY OF THE INVENTION

The present invention provides an electrical connector including an insulative housing, at lease one contact mounted to the insulative housing and a fusible element mounted to the contact. The contact includes a body portion extending along a main extending direction thereof and a mounting portion extending from the body portion. The mounting portion includes a support portion and first and second tails bent from the support portion along opposite directions in order to form a discrete receiving slot. The first and the second tails are substantially perpendicular to the body portion. The fusible element is received in the receiving slot and is in line with the body portion of the contact for reliable fixation.

A method for making a contact includes steps of providing a body portion and a mounting portion extending from the body portion. The mounting portion includes a support portion, first and second tails extending from the support portion, and an inner oval hole formed in the mounting portion. The inner oval hole is located in a first plane. The first and the second tails are separated from each other by a slit which is in communication with the inner oval hole. Then the first and the second tails are bent from the support portion along opposite directions in order that part of the inner oval hole is changed to a discrete receiving slot which is located at a second plane substantially perpendicular to the first plane, and the rest part of the inner oval hole formed in the support portion jointly with the receiving slot are adapted for accommodating a fusible element which is in line with the body portion.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
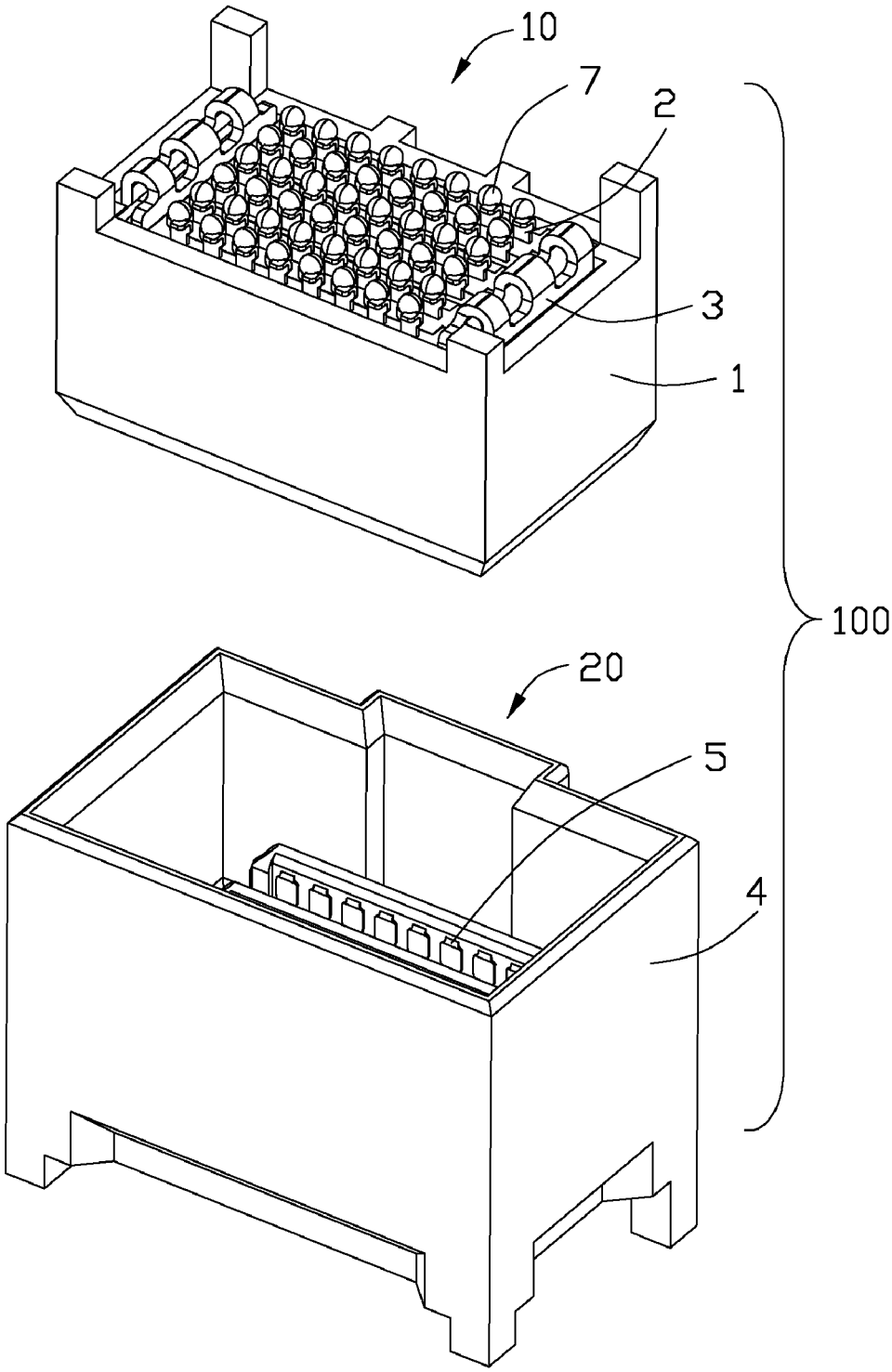
FIG. 1 is a perspective view of a connector assembly with first and second electrical connectors separated from each other in accordance with an embodiment of the present invention.

Reference will now be made to the drawing figures to describe the preferred embodiment of the present invention in detail. FIGS. 1 to 4 illustrate a mezzanine connector assembly 100 including a first electrical connector 10 and a second electrical connector 20 for receiving the first electrical connector 10. The first electrical connector 10 includes a first insulative housing 1, a plurality of first contact modules 2 assembled to the first insulative housing 1, and a pair of first organizers 3 mounted to the first insulative housing 1 for fastening the first contact modules 2. The second electrical connector 20 is similar to the first electrical connector 10 in configuration and includes a second insulative housing 4, a plurality of second contact modules 5 assembled to the second insulative housing 4, and a pair of second organizers 6 mounted to the second insulative housing 4 for fastening the second contact modules 5.

Figure 3:
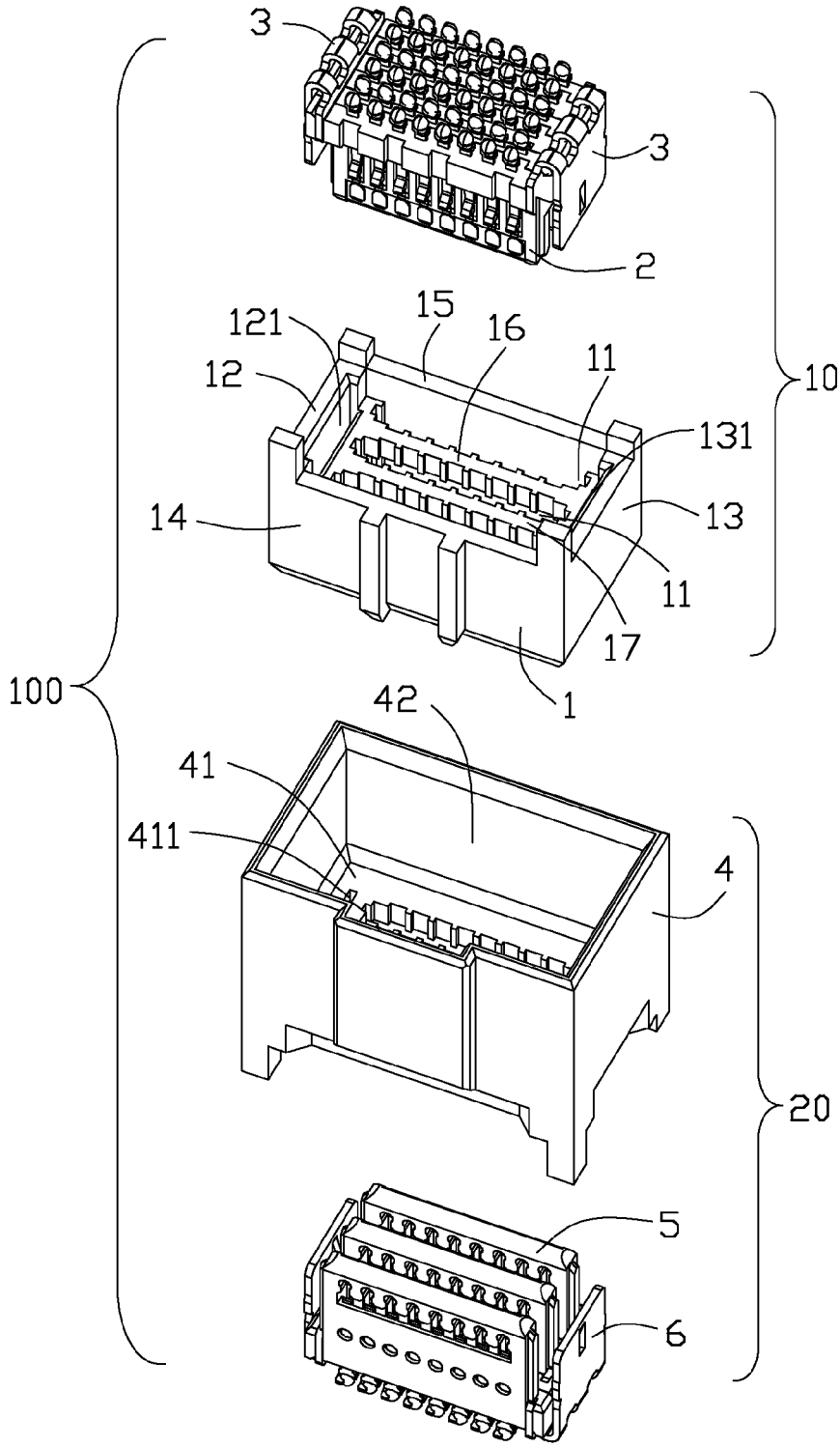
FIG. 3 is a partially exploded view of the connector assembly with first and second contact modules disengaged with first and second insulative housings of the first and the second electrical connectors, respectively.
Figure 4:
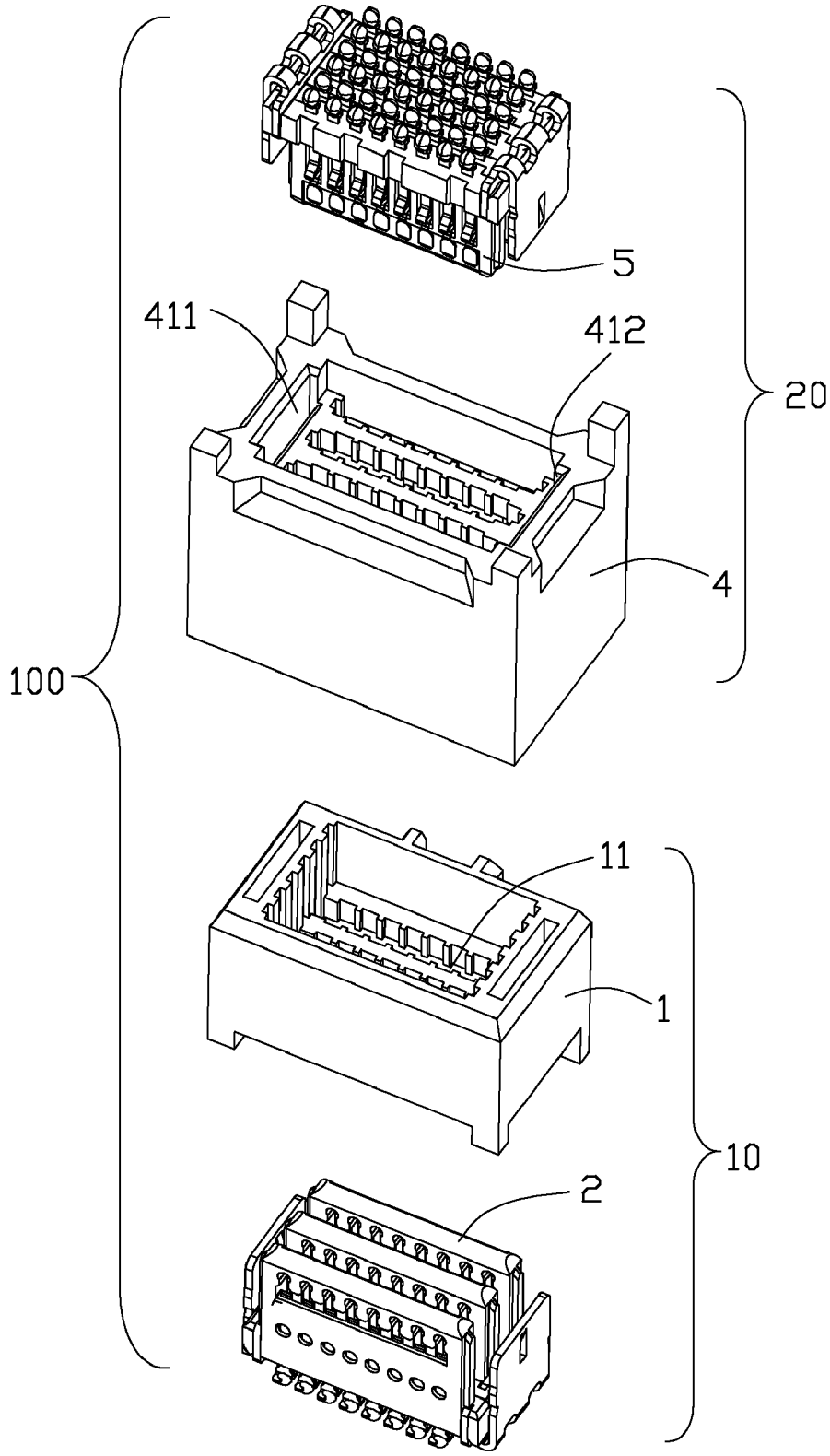
FIG. 4 is another partially exploded view of the connector assembly as shown in FIG. 3, taken from another aspect.

Referring to FIGS. 3 and 4, the first insulative housing 1 includes four peripheral walls including a left wall 12, a right wall 13, a front wall 14 and a rear wall 15. The left wall 12 and the right wall 13 define slots 121, 131, respectively, for receiving the pair of first organizers 3. Besides, the first insulative housing 1 includes a pair of parallel transverse bridges 16, 17 connecting the left wall 12 and the right wall 13 in order to form a plurality of transverse passageways 11 for receiving the first contact modules 2.

The second insulative housing 4 includes a bottom wall 41 and four peripheral walls extending from the bottom wall 41. The four peripheral walls jointly form a rectangular receiving space 42 for accommodating the first insulative housing 1. The bottom wall 41 defines a pair of slots 411, 412 for receiving the pair of second organizers 6.

Figure 9:
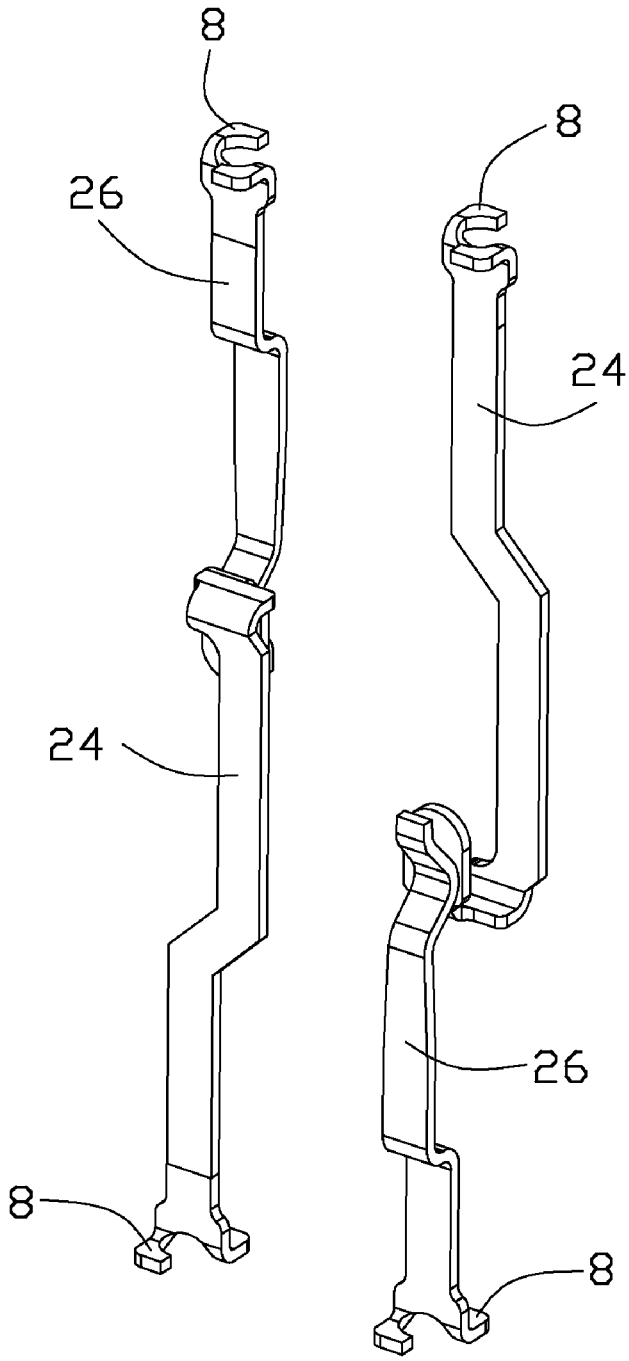
FIG. 9 is a perspective view of contacts of the first and the second electrical connectors mating with each other.
Figure 10:
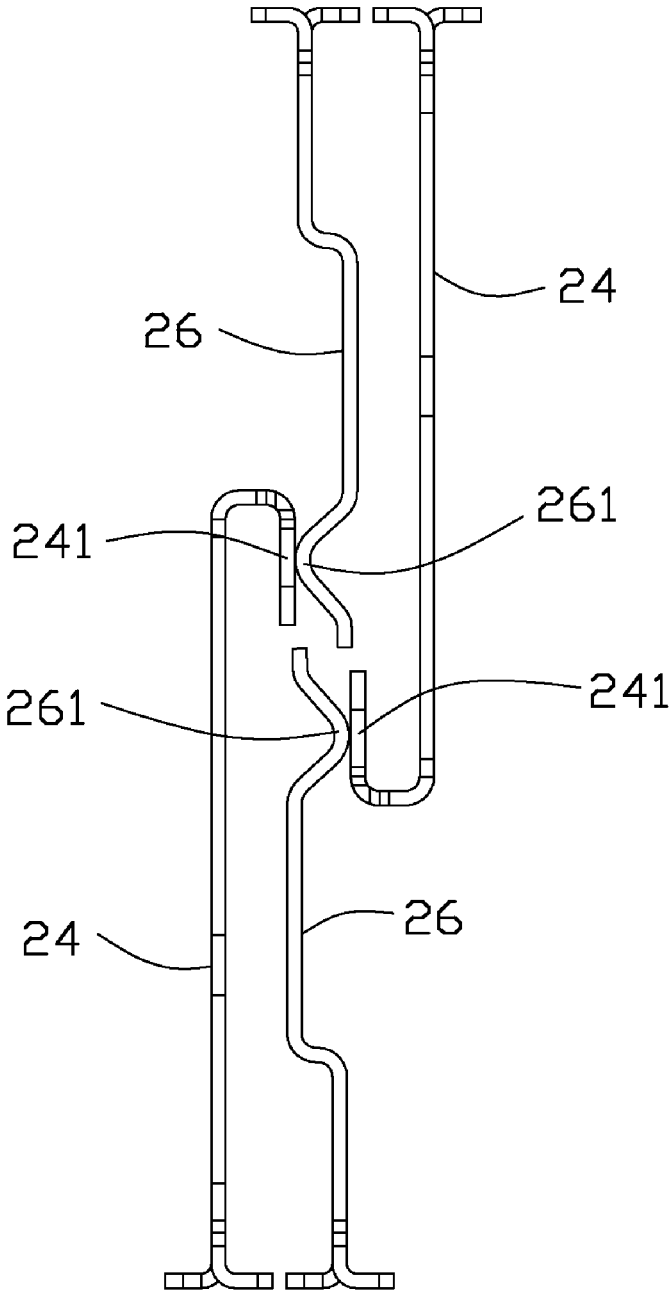
FIG. 10 is a front view of the contacts as shown in FIG. 9.

As shown in FIGS. 5 to 8, the first contact modules 2 and the second contact modules 5 are of the same configuration, and each includes a first part 21 and a second part 22 assembled to the first part 21. The first part 21 includes a first leadframe housing 23 and a plurality of first contacts 24 embedded in the first leadframe housing 23. The second part 22 includes a second leadframe housing 25 and a plurality of second contacts 26 insert-molded with the second leadframe housing 25. Each first contact 24 includes a flat contact portion 241 and each second contact 26 includes a protuberant contact portion 261 aligned with the flat contact portion 241 along a vertical direction. As shown in FIGS. 9 and 10, when the first and the second electrical connectors 10 and 20 are mated with each other, the flat contact portions 241 and the protuberant contact portions 261 of the first contact modules 2 abut against corresponding protuberant contact portions 261 and the flat contact portions 241 of the second contact modules 5, respectively.

Figure 5:
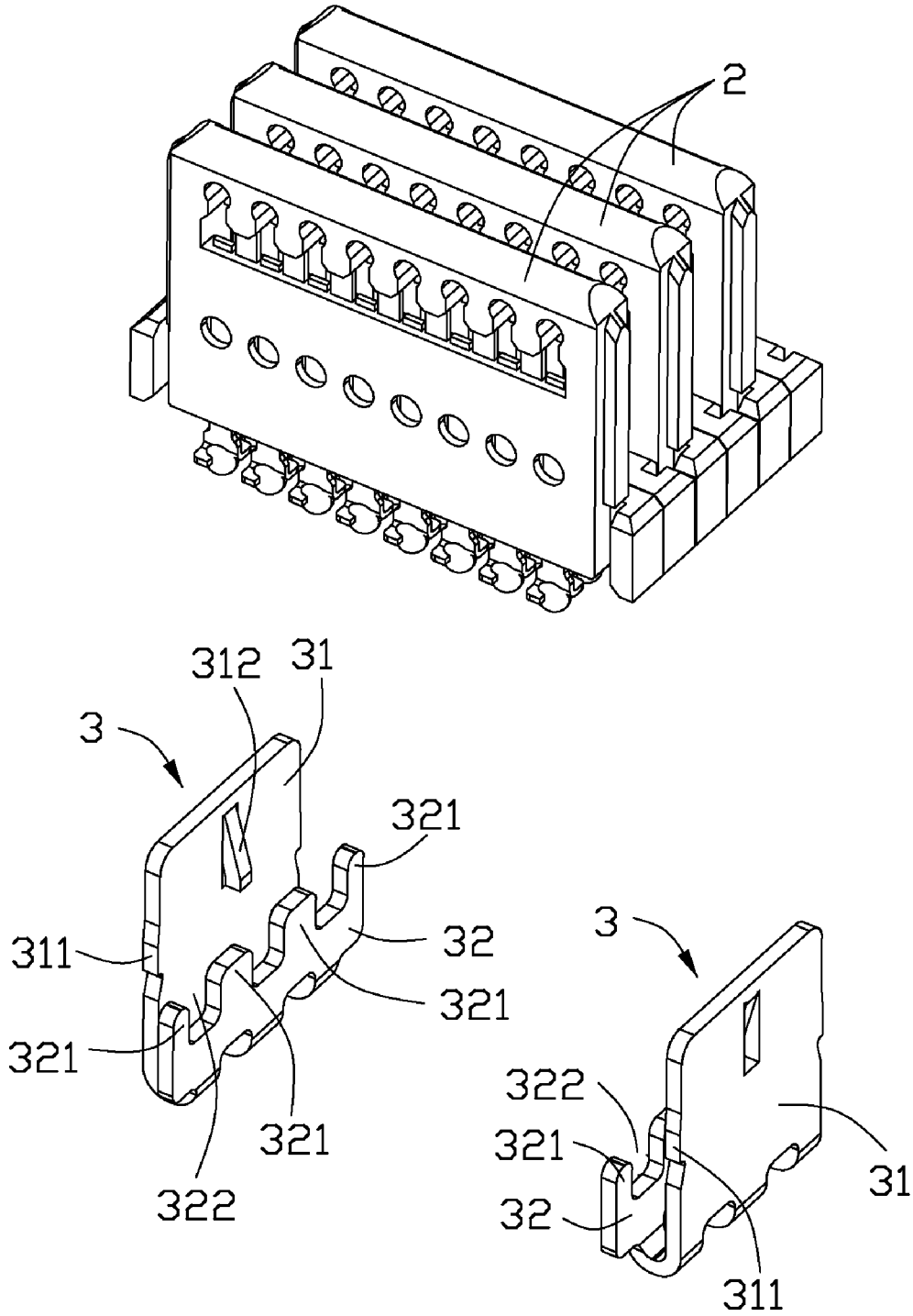
FIG. 5 is an exploded view of the first contact modules separated from a pair of first organizers as shown in FIG. 4.
Figure 6:
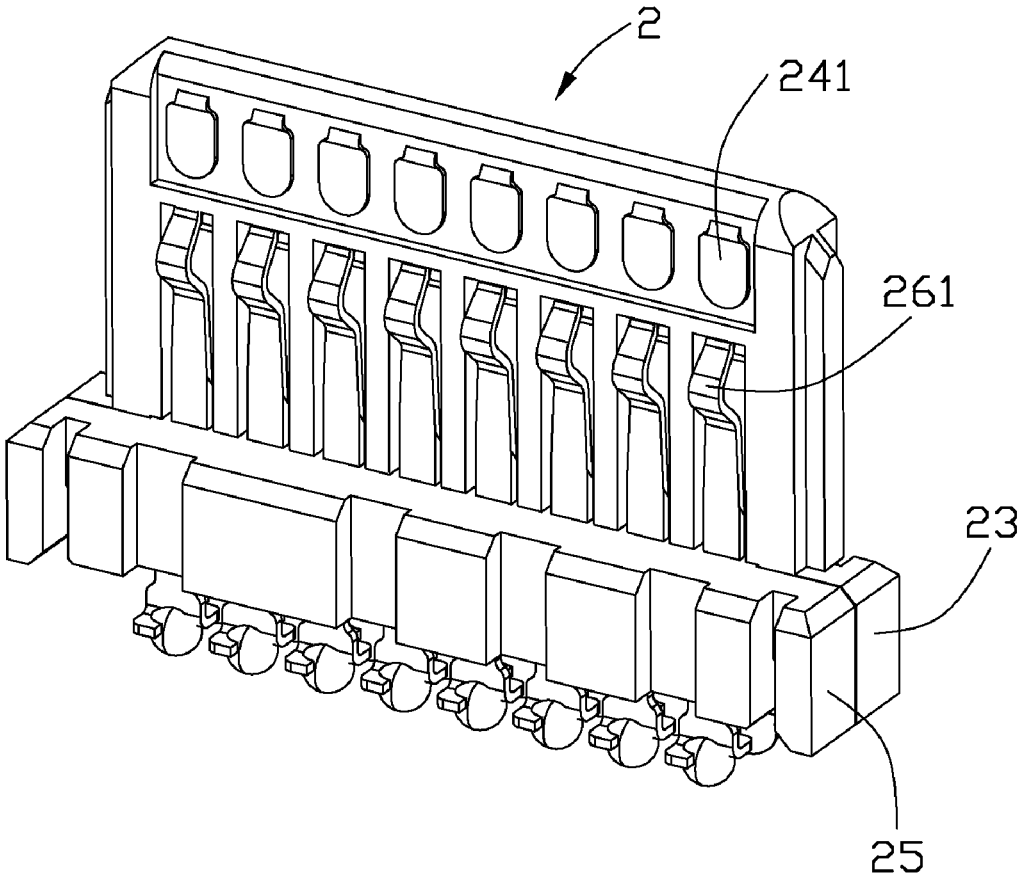
FIG. 6 is a perspective view of the first contact module.
Figure 7:
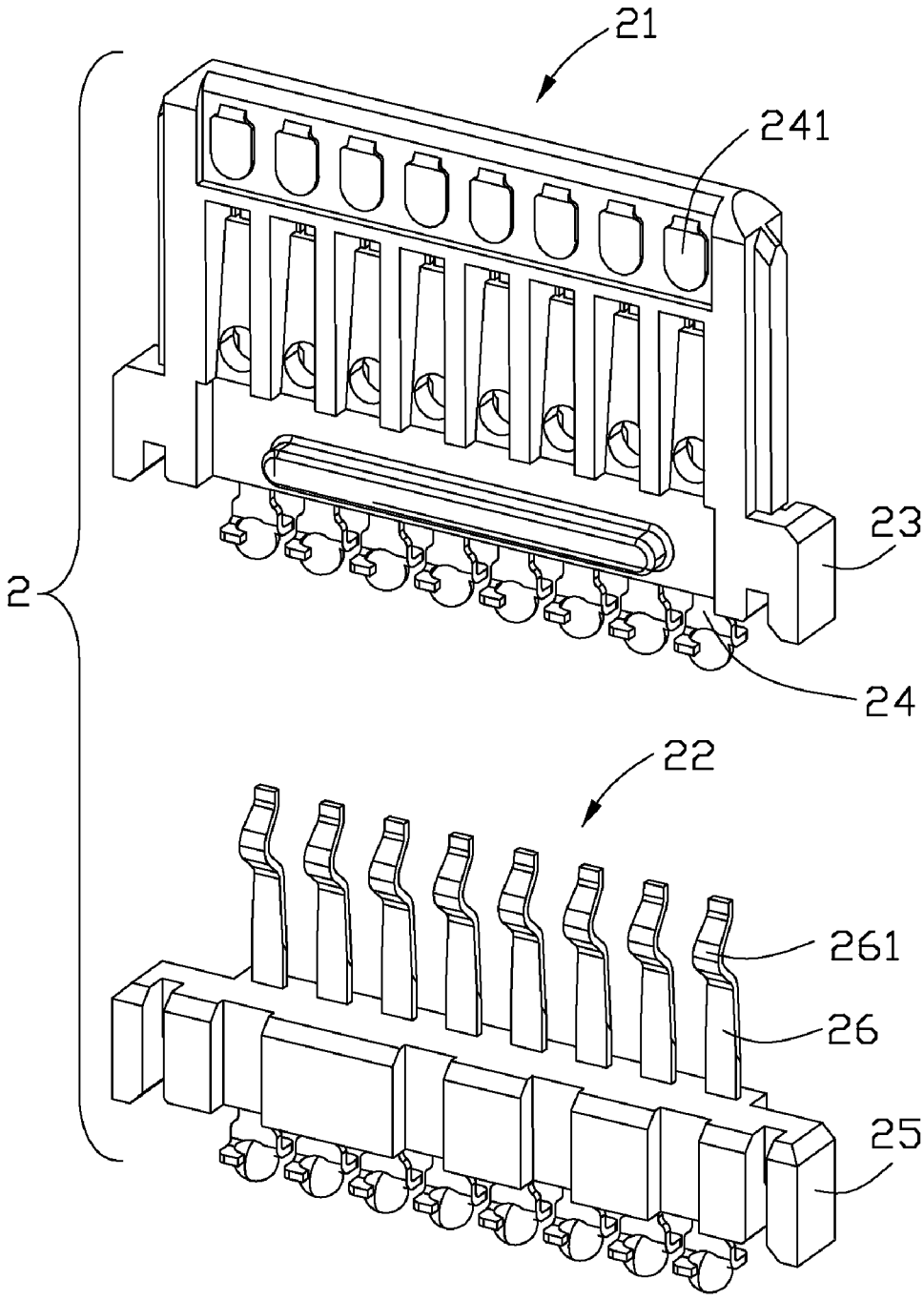
FIG. 7 is an exploded view of the first contact module with a first part separated from a second part.
Figure 8:
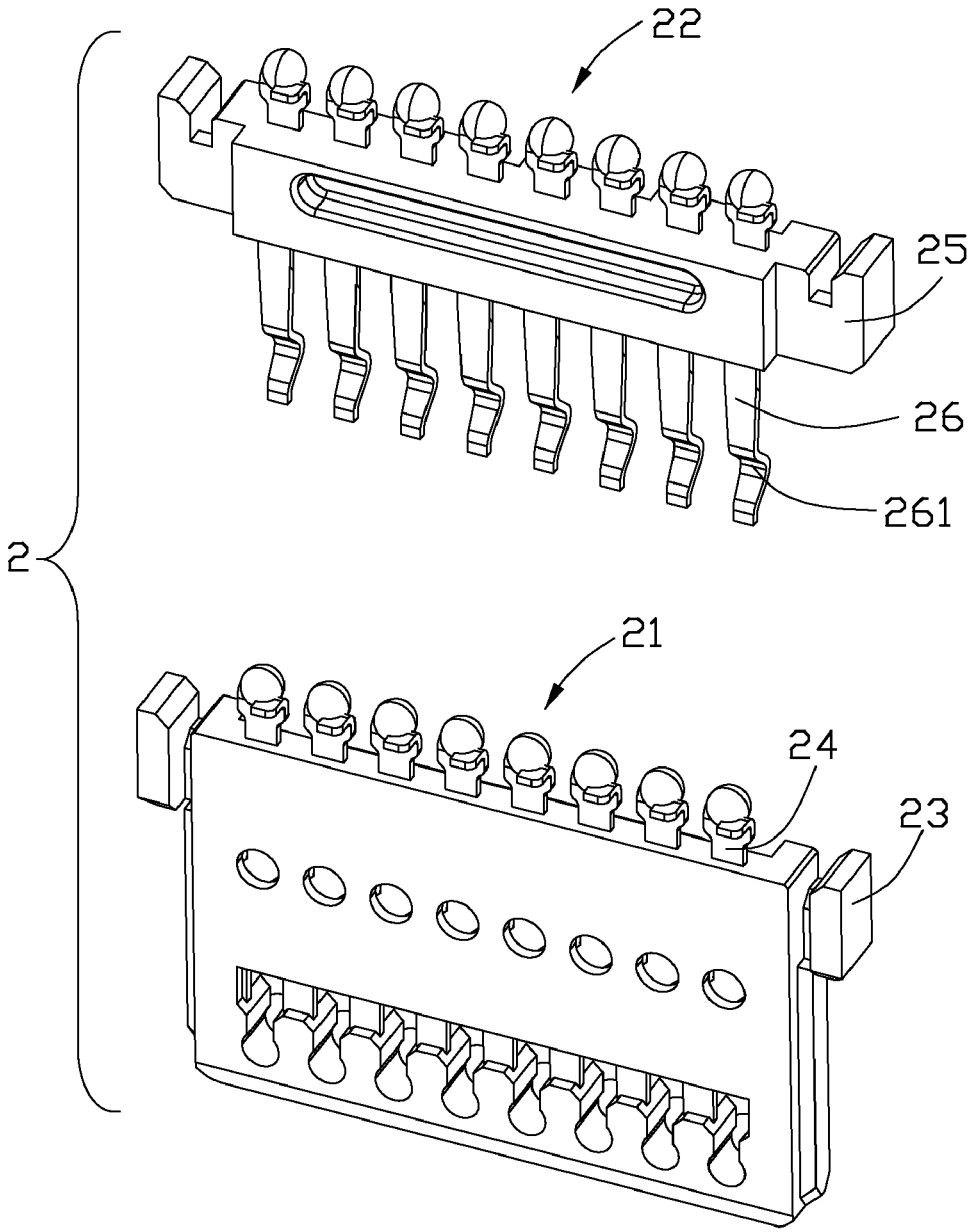
FIG. 8 is another exploded view of the first contact module as shown in FIG. 7, taken from a different aspect.

As shown in FIGS. 3 to 5, the first organizers 3 and the second organizers 6 are stamped from metal sheets. The first organizers 3 and the second organizers 6 are of the same configuration and each includes a flat engaging portion 31 and a bending portion 32 bent from an edge of the engaging portion 31. Each engaging portion 31 includes a plurality of lateral barbs 311 and a stamped sideward protrusion 312. The bending portion 32 includes a plurality of separate tabs 321 with openings 322 formed between adjacent tabs 321. In assembly, as shown in FIGS. 3 and 4, the first leadframe housing 23 and the second leadframe housing 25 are partially received in the opening 322 so as to be clipped by the adjacent tabs 321. As a result, the first contact modules 2 and the second contact modules 5 can be well organized by the first and the second organizers 3, 6. Besides, the engaging portions 31 of the first organizers 3 are inserted into the corresponding slots 121, 131 of the first insulative housing 1 for fixation. The engaging portions 31 of the second organizers 6 are inserted into the corresponding slots 411, 412 of the second insulative housing 4 for fixation as well. The lateral barbs 311 and the sideward protrusions 312 abut against the corresponding slots 121, 131, 411, 412 in order to improve fixation force.

Figure 2:
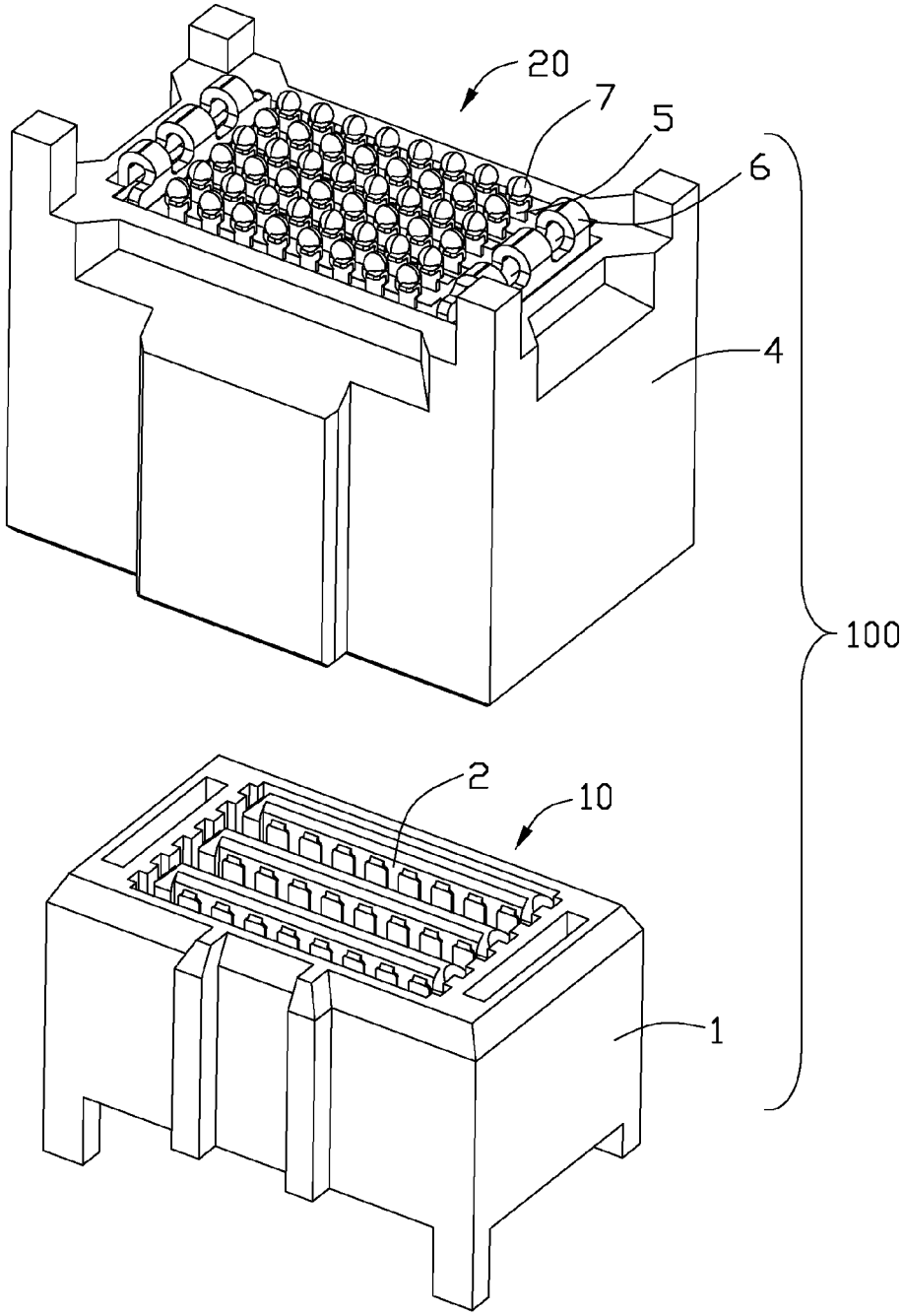
FIG. 2 is a perspective view of the connector assembly as shown in FIG. 1, taken from another aspect.

As shown in FIGS. 1 and 2, according to the preferred embodiment of the present invention, the first contacts 24 and the second contacts 26 are soldered to printed circuit boards via fusible elements, such as solder balls 7. Referring to FIG. 9, each contact 24, 26 is stamped from a meal sheet and includes a same contact pedestal 8 connected with the flat contact portion 241 and the protuberant contact portion 261.

Figure 11:
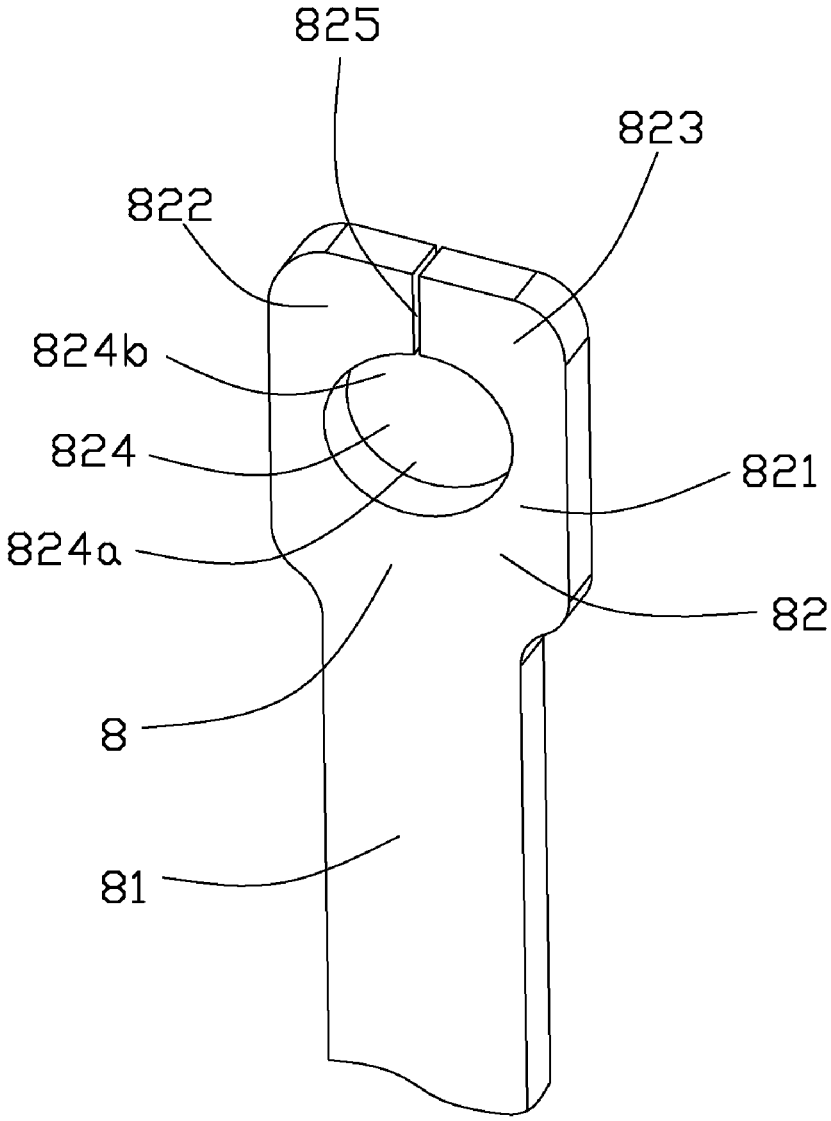
FIG. 11 is a partially perspective view of the contact showing a pedestal thereof before a bending process.
Figure 12:
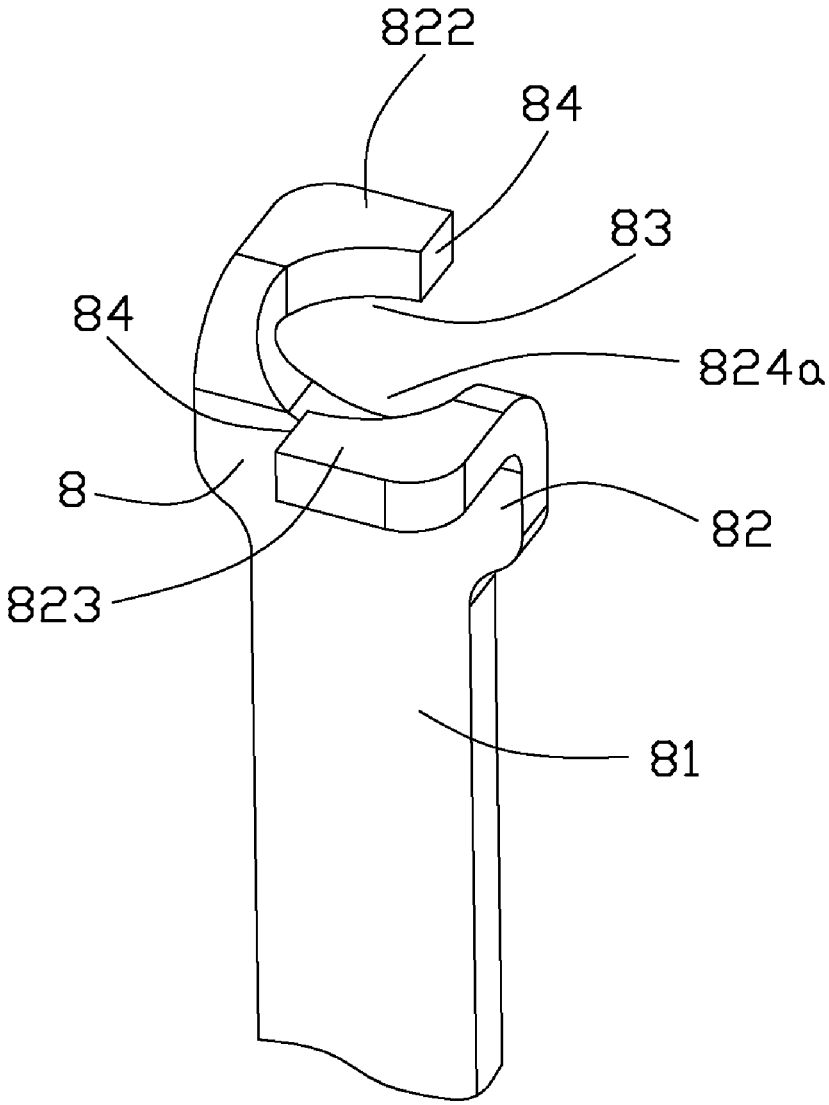
FIG. 12 is a partially perspective view of the pedestal as shown in FIG. 11 after the bending process.

Referring to FIG. 11, each contact pedestal 8 includes a flat body portion 81 extending along a main extending direction of the contact and a mounting portion 82 extending from and coplanar with the body portion 81 before a bending process. According to the preferred embodiment of the present invention, the body portion 81 extends along the vertical direction, as shown in FIG. 10. The mounting portion 82 includes a support portion 821 and a pair of first and second tails 822, 823 extending from the support portion 821. As shown in FIGS. 11 and 12, joints of the support portion 821 and the first and the second tails 822, 823 are the narrowest parts along the vertical direction along which the contacts 24, 26 extend. An inner oval hole 824 is formed in the mounting portion 82 and located in a vertical plane. The oval hole 824 includes a depressed opening **824*a* formed by the support portion 821 and an arced slot 824*b* formed between the first and the second tails 822, 823. The first and the second tails 822, 823 are separated from each other by a slit 825 which is in communication with the oval hole 824**.

In the bending process, as shown in FIG. 12, the first and the second tails 822, 823 are bent from the support portion 821 along opposite directions. The original arced slot **824*b* is then changed to a receiving slot 83 which is substantially located in a horizontal plane. The first and the second tails 822, 823 are bent from the support portion 821 along the joints in order to form a relatively larger receiving slot 83. The first and the second tails 822, 823 are substantially perpendicular to the support portion 821 and are located in the horizontal plane. Free ends 84 of the first and the second tails 822, 823 are located at opposite sides of the body portion 81 and are arranged in a line which is perpendicular to the body portion 81. The receiving slot 83 is discrete or is thus fored such that the free ends 84 of the first and the second tails 822, 823 are separated from and disconnected with each other. Since the first and the second tails 822, 823, before being bending, are symmetrical along the slit 825 and are coplanar with the body portion 81, cost-effective stamping process thereof can be realized. Besides, in the subsequent bending process, the receiving slot 83 can be easily formed by bending the first and the second tails 822, 823** along opposite directions.

Figure 13:
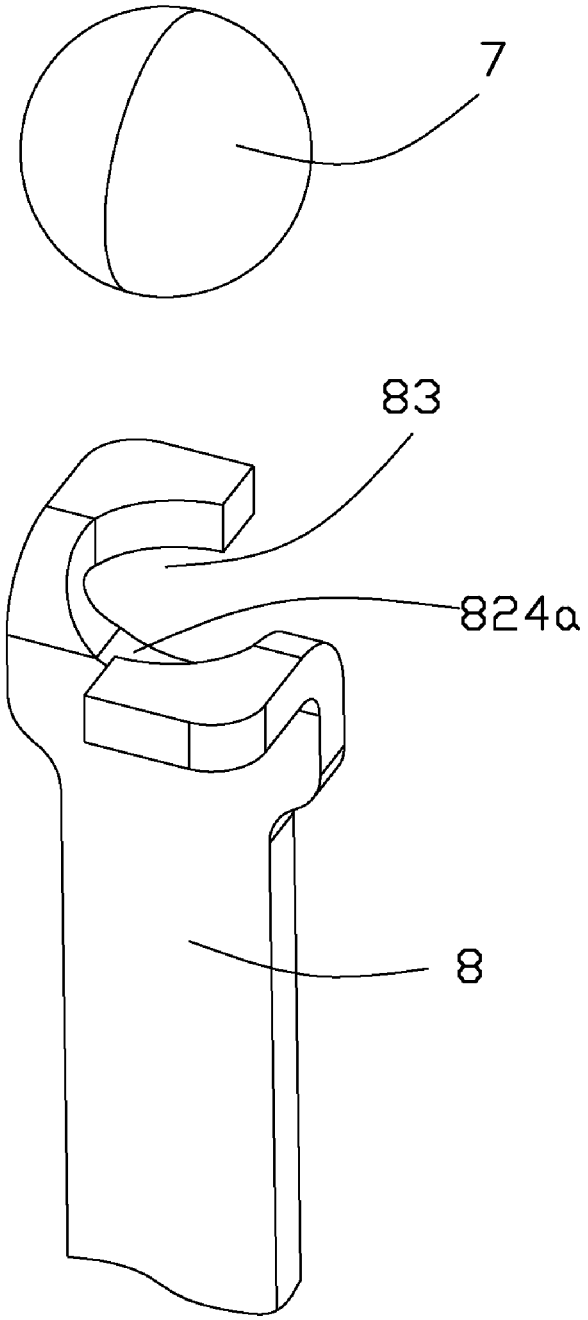
FIG. 13 is a perspective view of the pedestal separated from a fusible element.
Figure 14:
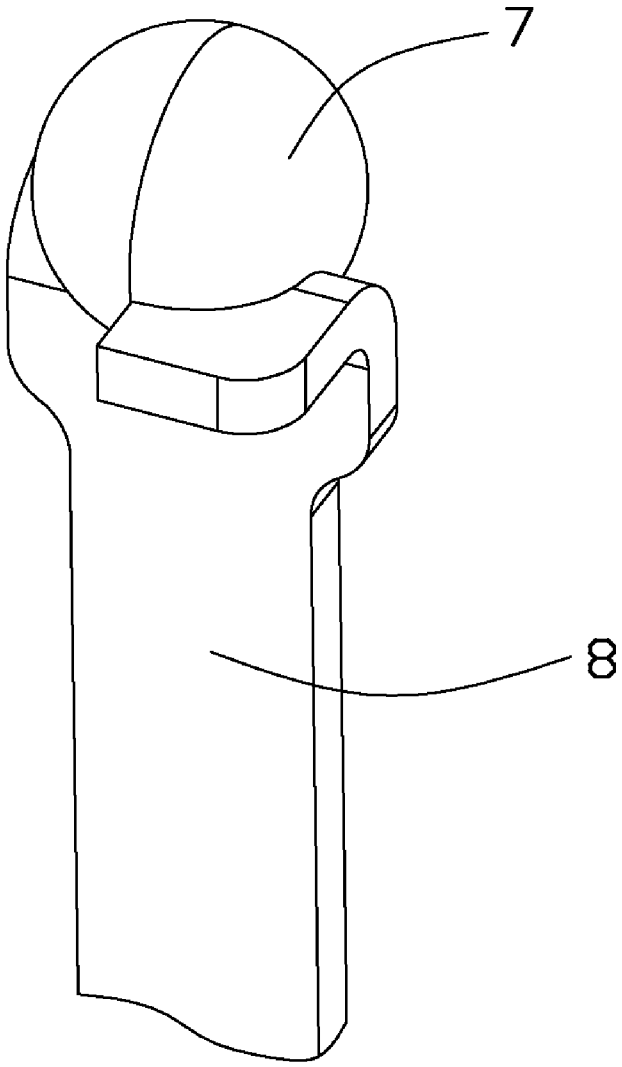
FIG. 14 is a perspective view of the pedestal with the fusible element mounted thereto.

As shown in FIGS. 13 and 14, the solder ball 7 is mounted to the contact pedestal 8 through the receiving slot 83 and supported by the arced depressed opening **824*a* to realize reliable mechanical fixation. Besides, as shown in FIG. 14, since the solder ball 7 is in line with the body portion 81**, robust soldering effect can be accordingly achieved.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

an insulative housing;

at least one contact mounted to the insulative housing, the contact comprising a body portion along a main extending direction of the contact and a mounting portion extending from the body portion, the mounting portion comprising a substantially planar support portion and first and second tails bent from the support portion along opposite directions to form a receiving slot; and a fusible element received in the receiving slot and restricted by the first and the second tails along a horizontal direction; wherein each of the first and the second tails is located at a horizontal plane perpendicular to the main extending direction, and the fusible element is supported by the support portion along the main extending direction.

2. The electrical connector as claimed in claim 1, further comprising a leadframe housing over-molded with the contact, and an organizer having an engaging portion fixed in the insulative housing and a bending portion clipping the leadframe housing to retain the leadframe housing to the insulative housing.

3. The electrical connector as claimed in claim 1, wherein the mounting portion comprises a pair of narrowed portions connected between the support portion and the first and the second tails, the first tail is bent perpendicularly with respect to the support portion along one of the narrowed portions, and the second tail is bent perpendicularly with respect to the support portion along the other narrowed portion.

4. The electrical connector as claimed in claim 1, wherein the support portion is coplanar with the body portion.

5. The electrical connector as claimed in claim 1, wherein the support portion defines an arcuate depressed opening supporting the fusible element.

6. The electrical connector as claimed in claim 5, wherein the arcuate depressed opening and the receiving slot are located at mutually perpendicular planes, respectively.

7. An electrical connector comprising:

an insulative housing defining a plurality of passageways;

a plurality of contacts disposed in the corresponding passageways, respectively, each of said contacts defining a body portion disposed in the corresponding passageway, a contact portion located in an upper section of the passageway, and a mounting portion located at a bottom end of the body portion and in a lower section of the passageway; wherein the mounting portion defines a pair of opposite tails in a diagonal direction and each of said tails defines a quadrant of inner circumference, the quadrants of inner circumference of the tails facing each other along said diagonal direction for holding a solder ball therebetween.

8. The electrical connector as claimed in claim 7, wherein said mounting porting defines a center line vertically aligned with the body portion.

9. The electrical connector as claimed in claim 8, wherein the mounting portion contains no portions along the other diagonal direction perpendicular to said diagonal direction.

10. The electrical connector as claimed in claim 7, wherein the mounting portion forms an arcuate depressed opening facing toward the tails.

* * * * *